United States Patent [19]

Schirtzinger

[11] 4,108,101

[45] Aug. 22, 1978

[54] TOWING SYSTEM FOR CARGO CONTAINERS

[75] Inventor: Joseph F. Schirtzinger, Pasadena, Calif.

[73] Assignee: Sea-Log Corporation, Pasadena, Calif.

[21] Appl. No.: 747,630

[22] Filed: Dec. 6, 1976

[51] Int. Cl.[2] ..... B63B 21/56

[52] U.S. Cl. ..... 114/245; 114/250; 114/321

[58] Field of Search ..... 114/242, 245, 244, 250, 114/253, 258, 259, 16 R, 16 A, 249

[56] References Cited

U.S. PATENT DOCUMENTS

| | | | |
|---|---|---|---|
| 1,356,773 | 10/1920 | Lake | 114/16 R |
| 3,296,994 | 1/1967 | Schirtzinger | 114/74 T |
| 3,686,048 | 8/1972 | Schirtzinger | 156/161 |
| 3,722,452 | 3/1973 | Wynn, Jr. | 114/249 X |
| 3,999,499 | 12/1966 | Kitabayashi | 114/244 |

FOREIGN PATENT DOCUMENTS

| | | | |
|---|---|---|---|
| 1,231,486 | 5/1971 | United Kingdom | 114/244 |

*Primary Examiner*—Robert B. Reeves
*Assistant Examiner*—Edward M. Wacyra
*Attorney, Agent, or Firm*—Christie, Parker & Hale

[57] ABSTRACT

An arrangement for transporting in which a self-propelled surface vessel tows a submergible elongated cargo container by means of a semi-rigid boom extending from the stern of the vessel to the nose of the cargo container. The position of the boom is controlled from the stern of the vessel to hold the nose of the container at a level below the wake of the towing vessel.

9 Claims, 3 Drawing Figures

TOWING SYSTEM FOR CARGO CONTAINERS

FIELD OF THE INVENTION

This invention relates to submerged barges for transporting cargo, and more particularly, is concerned with a boom arrangement for towing a submerged cargo container from a surface vessel.

BACKGROUND OF THE INVENTION

With the increasing movement of oil over the world's oceans, there has developed a need for ever larger tankers to move the oil. Increase in tanker size presents a number of problems, including structural problems of designing the vessel to withstand the surface wave action encountered, the docking problem difficulties in loading and unloading, and maneuvering over existing navigable waterways. While the use of barges or floating cargo containers has been proposed to permit existing tankers to effectively increase their capacity, towing at sea is a hazardous undertaking. Conventionally the tow lines must be made relatively long to permit damping of the relative movement between the two vessels, and give the barge room to maneuver without colliding with the towing vessel. Also, the barge or container must be far enough back to be outside the influence of the propeller wake of the towing vessel.

SUMMARY OF THE INVENTION

The present invention provides an arrangement for towing a cargo container from the stern of a tanker or other conventional cargo ship in a manner which provides close coupling and control of the towed barge while providing effective damping of the relative movement between the barge and the towing vessel. This arrangement includes a semi-rigid boom which extends from the stern of the towing vessel to the nose of an elongated submersible container. The boom is coupled to the stern of the vessel through a hydraulically controlled linkage system which holds the boom in a downward angle so that the connection of the boom to the towed container is at a submerged depth below that of the propeller wake of the towing vessel. The buoyancy of the loaded container and the attitude of the container in the water are controlled remotely from the towing vessel. The towing boom includes a structural rod of an epoxy or other resin or composite material with longitudinally aligned reinforcing fibers which give it great strength while allowing it to flex substantially to compensate for relative motion of the stern of the towing vessel relative to the container.

DESCRIPTION OF THE DRAWINGS

For a better understanding of the invention, reference should be made to the accompanying drawings, wherein.

DETAILED DESCRIPTION

Figure 1:
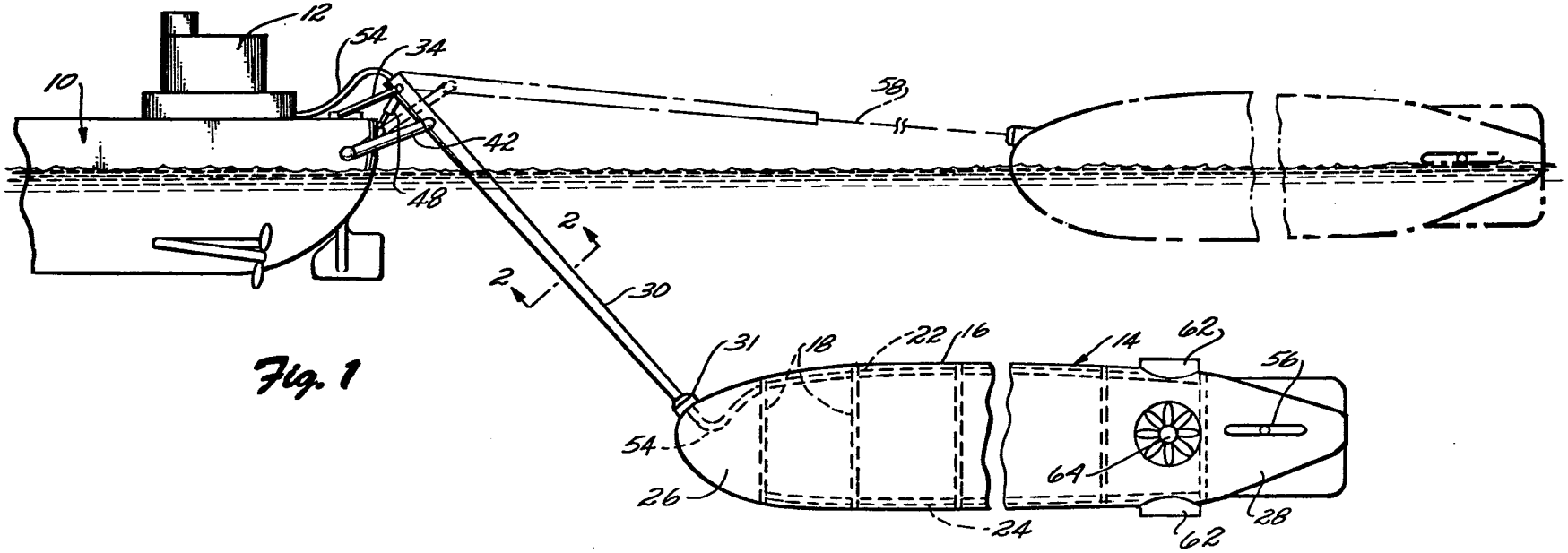
FIG. 1 is an elevational view of a preferred embodiment of the invention.
Figure 3:
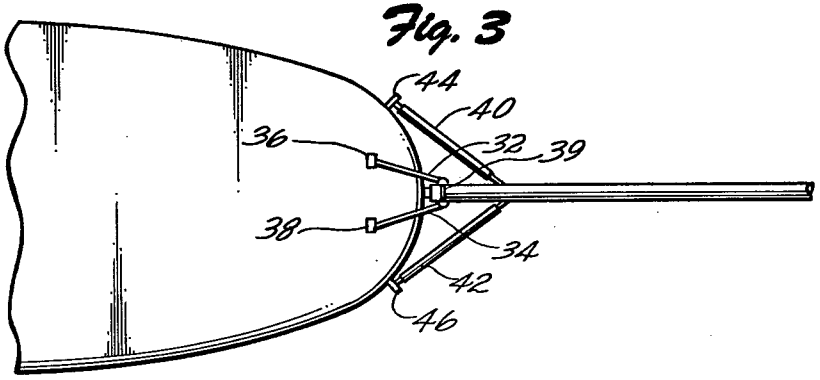
FIG. 3 is a partial top view of the stern of the surface vessel.

Referring to the drawing in detail, the numeral 10 indicates generally a surface vessel such as an oil tanker or the like, only the stern portion of the vessel being shown in the figure. The bridge and cabin area of the vessel, indicated at 12, are provided in the aft portion of the vessel. A submergible cargo container 14 is designed to operate as much as 80 to 100 ft. below the surface of the water. This submersible container 14 has a surrounding outer wall 16 which is divided by bulkheads 18 into a series of compartments in which can be stored oil or other liquid cargo or ballast. The compartments can also be used to hold air to control the buoyancy of the system. The cargo container 14 preferably is provided with a plurality of longitudinal flotation-cargo tubes 22 and ballast-cargo tubes 24 which interconnect the fore and aft compartments 26 and 28. The tubes may be filled with air or with water or a higher specific gravity slurry to control the overall buoyancy of the container. Preferably the container is trimmed so as to have a slightly positive buoyancy which causes the container to rise slowly to the surface in the event it becomes free of the towing vessel. The towed vessel or a container may employ a structure substantially as set forth in U.S. Pat. No. 3,296,994 incorporated herein by reference.

The container 14 is towed from the surface vessel 10 through a faired semi-rigid boom 30 extending from the stern of the vessel downwardly at an abrupt angle to the surface of the water to a Universal coupling 31 at the bow of the submerged container 14. The coupling 31 may be a ball joint connection, for example, which allows the container 14 to freely adjust its attitude about the point of coupling.

The upper end of the boom 30 is coupled to the stern of the vessel 10 by a pair of linkage arms 32 and 34 which are anchored to the deck of the surface vessel by hinge supports 36 and 38, respectively. The outer ends of the arms 32 and 34 are connected by a pin 39 which passes through the upper end of the boom 30 and provides a hinged support therefor.

The downward angle of the boom 30 is controlled by a pair of hydraulic actuators 40 and 42. The linear actuators are connected at one end to the stern of the vessel by hinge supports 44 and 46, respectively. The other ends of the actuators 40 and 42 are connected to the boom 30 at a point below the pin 39. Thus operation of the linear actuators 40 and 42 moves the boom 30 from a substantially horizontal position, as shown by the broken lines in FIG. 1, to the operative position in which the boom extends downwardly at substantially 45° or greater to the surface of the water. The linkage arms 36 and 38 and the actuators 40 and 42 forms a parallelogram type of support which allows the stern of the vessel 10 to move up and down relative to the boom 30. A hydraulic actuator 48 may be connected between the pin 39 and the stern of the vessel 10 to dampen or control the relative vertical movement between the boom 30 and the stern of the vessel.

Figure 2:
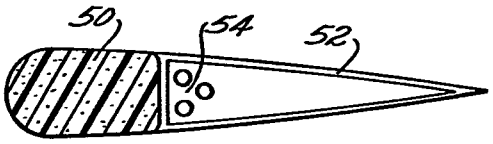
FIG. 2 is a sectional view taken on the line 2—2 of FIG. 1.

As shown by the sectional view of FIG. 2, the boom includes a rigid structural member 50 which preferably is constructed of an epoxy or other resin material reinforced with glass fibers or other suitable fibers which are aligned longitudinally of the boom. A suitable material for this purpose is described in U.S. Pat. No. 3,686,048. The structural member 50 forms the leading edge of the boom and is rounded in the leading edge to reduce resistance to the flow of water around the boom. The trailing edge of the boom is formed from a hollow fairing 52 through which hydraulic lines, electrical cable and air lines for controlling ballast may extend between the surface vessel and the container. The power cable control lines and ballast lines are indicated generally at 54 and extend out the upper end of the boom 30 to a control room in the bridge section 12 of the surface vessel. They connect with the stern compartment 28 of the container vessel 14 through one of the tubes 22.

To control the trim of the container, horizontal control vanes 56 are provided at the stern of the container 14. The angle of the vanes about a transverse horizontal axis is controlled by a suitable motor drive (not shown) within the stern compartment 28 of the container 14. The control motors in turn may be controlled by signals from the surface vessel through the cable 54. The control vanes 56 are normally set to keep the stern from rising due to the positive buoyancy, thereby maintaining a level trim of the container beneath the water, the level of the bow of the container being controlled by the angle of the boom 30.

In circumstances where water depth may be insufficient or other conditions make it necessary to bring the container 14 to the surface and tow it in conventional manner from the surface vessel, the boom 30 is raised to the horizontal position by extending the actuators 40 and 42. The boom 30 may then be used as a guide for a cable extending from a suitable windlass on the vessel 10 through the boom to the bow of the container 14, as indicated by the dashed line in FIG. 1. The cable 58 is played out to allow the container 14 to fall astern by a sufficient distance so as to be unaffected by the wake of the vessel, as in any conventional towing operation.

From the above description it will be seen that a towing arrangement is provided which maintains the container in close coupled relationship to the towing vessel. By holding the container in a submerged position, even though closely coupled to the vessel, it is below the influence of the propeller wake or surface wave action. The hydraulic actuators 40, 42, and 48 permit the towing load of the container to be transferred to the surface vessel 10 while permitting the vessel 10 to pitch and roll under the influence of the surface wave action. Because the structural member 50 of the boom 30 is relatively thin in a transverse direction, considerable sideways flexing of the boom 30 takes place with the rolling of the surface vessel 10 without any adverse affect on the towing action. The container 14 can be relatively simple and inexpensive in terms of the cargo volume compared to a conventional tanker. All power for moving and controlling the trim of the container 14 is derived from the surface vessel 10, although the container 14 may be provided with independent thrust generating means, if desired.

Since the control surfaces or vanes 56 on the container 14 only function effectively when the ship is underway and the vanes are moving through the water, it may be desirable to provide both vertical and horizontal thrusters, such as indicated at 62 and 64, respectively, which can be driven in conventional manner to provide either vertical or horizontal thrust to the stern of the container 14. The thrusters can be used to particular advantage when it is desired to back up the towing vessel 10 so that the container vehicle 14 is moved ahead of the towing vehicle 10. By providing the thrusters, the boom 30 may be extended from the bow of a tug or other surface vessel so as to push the load in front of the surface vessel rather than towing it in the rear, as is sometimes preferable in negotiating more restricted bodies of water, canals, rivers, and the like.

What is claimed is:

1. Apparatus for transporting cargo in a body of water comprising a self-propelled surface vessel, a submergible elongated cargo container, a boom including a semi-rigid continuous structure capable of transferring lateral forces producing a moment about one end of the boom to the other end of the boom, means coupling one end of the boom to the stern of the surface vessel, and means coupling the other end of the boom to the forward end of the cargo container, the means coupling the boom to the surface vessel including drive means for adjusting the angle in a vertical plane between the axis of the boom and the surface vessel to raise and lower the cargo vessel by means of the boom, and means holding the boom at any selected angle against any lateral force exerted on one end of the boom by the cargo container tending to rotate the boom about the end connected to the surface vessel, whereby the boom acts to hold the end of the cargo vessel at a selected depth relative to the surface vessel, the length of the boom being such that the lower end extends downwardly into the water substantially below the draft of the surface vessel, whereby the boom holds the forward end of the container at a depth below the influence of the wake of the vessel, the boom being sufficiently rigid to resist lateral or vertical forces imposed on the lower end by the cargo container.

2. Apparatus of claim 1 wherein the container includes means at the rearward end of the container for controlling the elevation of the stern of the container relative to the forward end of the container.

3. Apparatus of claim 2 wherein said means for controlling the elevation includes a thruster means for applying a vertical force to the stern of the container to move the stern of the container vertically.

4. Apparatus of claim 1 wherein the structural member is made of a resin material with longitudinally aligned reinforcing fibers.

5. Apparatus of claim 4 wherein the structural member is more flexible in a lateral direction than in the fore and aft direction.

6. Apparatus of claim 1 wherein said means coupling the boom to the stern of the vessel includes a linkage means which permits relative vertical movement of the stern relative to the boom.

7. Apparatus of claim 6 wherein said means coupling the boom to the surface vessel includes energy absorbing means for damping the relative motion between the surface vessel and the boom.

8. Apparatus of claim 1 wherein the means coupling the lower end of the boom to the submerged container includes a ball and socket joint.

9. Apparatus of claim 1 including means for adjusting the buoyancy of the container to maintain the container at a slightly positive buoyancy.

* * * * *